US008663395B2

(12) United States Patent
Warner et al.

(10) Patent No.: US 8,663,395 B2
(45) Date of Patent: Mar. 4, 2014

(54) WAREWASHER INCLUDING HEAT RECOVERY SYSTEM WITH HOT WATER SUPPLEMENT

(75) Inventors: Charles E. Warner, Troy, OH (US); Brian E. Stump, Englewood, OH (US); Walter L. Debrosse, Piqua, OH (US); Donnivan K. Conley, Troy, OH (US)

(73) Assignee: Premark FEG L.L.C., Glenview, IL (US)

( * ) Notice: Subject to any disclaimer, the term of this patent is extended or adjusted under 35 U.S.C. 154(b) by 0 days.

(21) Appl. No.: 13/416,720

(22) Filed: Mar. 9, 2012

(65) Prior Publication Data

US 2012/0160271 A1 Jun. 28, 2012

Related U.S. Application Data

(63) Continuation of application No. 12/186,987, filed on Aug. 6, 2008, now Pat. No. 8,157,924.

(60) Provisional application No. 61/043,589, filed on Apr. 9, 2008.

(51) Int. Cl.
*B08B 7/04* (2006.01)
*B08B 3/02* (2006.01)

(52) U.S. Cl.
USPC ..... 134/18; 134/25.2

(58) Field of Classification Search
USPC ..... 134/18, 25.2, 42
See application file for complete search history.

(56) References Cited

U.S. PATENT DOCUMENTS

| | | | |
|---|---|---|---|
| 3,315,293 | A | 4/1967 | Werneke |
| 3,598,131 | A | 8/1971 | Weihe, Jr. |
| 3,789,860 | A | 2/1974 | Katterheinrich et al. |
| 3,946,802 | A | 3/1976 | Christenson |
| 3,965,494 | A | 6/1976 | Baker |
| 3,986,345 | A | 10/1976 | Pilz et al. |
| 4,098,616 | A | 7/1978 | Dorius et al. |
| 4,125,148 | A | 11/1978 | Molitor |

(Continued)

FOREIGN PATENT DOCUMENTS

| | | |
|---|---|---|
| DE | 2643173 A1 | 4/1977 |
| GB | 1486725 | 9/1977 |

(Continued)

OTHER PUBLICATIONS

Non-Final Office Action, mailed Aug. 13, 2013, U.S. Appl. No. 12/553,341, filed Sep. 3, 2009, 17 pages.

*Primary Examiner* — Saeed T Chaudhry
(74) *Attorney, Agent, or Firm* — Thompson Hine LLP

(57) ABSTRACT

A warewasher for washing wares includes a housing defining an internal space with at least one spray zone for washing wares. A liquid delivery system provides a spray of liquid within the spray zone. A tank includes an inlet that is connected to a hot water source for filling the tank with hot water. The liquid delivery system receives water from the tank. An exhaust vents heated air from the housing. A final rinse system is connected to a cold water source. A heat recovery system is located between the final rinse system and the cold water source. The heat recovery system transfers heat from the exhaust air to the cold water provided from the cold water source. A valve associated with the hot water source selectively supplements the water exiting the heat recovery system with hot water from the hot water source.

16 Claims, 5 Drawing Sheets

(56) References Cited

U.S. PATENT DOCUMENTS

| | | | | |
|---|---|---|---|---|
| 4,129,179 | A | 12/1978 | Molitor | |
| 4,219,044 | A | 8/1980 | Wilson | |
| 4,326,551 | A | 4/1982 | Voorhees | |
| 4,519,440 | A | 5/1985 | Weitman | |
| 4,529,032 | A | 7/1985 | Molitor | |
| 4,531,572 | A | 7/1985 | Molitor | |
| 5,331,984 | A | 7/1994 | Isagawa | |
| 5,642,742 | A | 7/1997 | Noren et al. | |
| 5,660,193 | A | 8/1997 | Archer et al. | |
| 5,794,634 | A | 8/1998 | Noren et al. | |
| 5,816,273 | A | 10/1998 | Milocco et al. | |
| 5,829,459 | A | 11/1998 | Milocco et al. | |
| 5,884,694 | A | 3/1999 | Tanenbaum | |
| 5,934,078 | A | 8/1999 | Lawton, Jr. et al. | |
| 6,072,153 | A | 6/2000 | Aoki et al. | |
| 6,357,245 | B1 | 3/2002 | Weng et al. | |
| 6,591,846 | B1 | 7/2003 | Ferguson et al. | |
| 7,103,992 | B2 | 9/2006 | Deden et al. | |
| RE40,123 | E | 3/2008 | Johansen et al. | |
| 8,157,924 | B2 | 4/2012 | Warner et al. | |
| 8,498,523 | B2 | 7/2013 | Deivasigamani et al. | |
| 2003/0005731 | A1 | 1/2003 | Montgomery | |
| 2003/0178498 | A1 | 9/2003 | Saitoh et al. | |
| 2004/0123880 | A1 | 7/2004 | Chiles et al. | |
| 2004/0187339 | A1* | 9/2004 | Duden et al. | 34/218 |
| 2004/0200905 | A1 | 10/2004 | Saitoh et al. | |
| 2004/0227003 | A1 | 11/2004 | Alvarez et al. | |
| 2004/0261820 | A1 | 12/2004 | Monsrud et al. | |
| 2005/0167516 | A1 | 8/2005 | Saitoh et al. | |
| 2006/0073430 | A1 | 4/2006 | Chiles et al. | |
| 2006/0090798 | A1* | 5/2006 | Beagen et al. | 137/602 |
| 2007/0089230 | A1 | 4/2007 | Hendricks | |
| 2007/0143914 | A1 | 6/2007 | Shiral et al. | |
| 2007/0170270 | A1 | 7/2007 | Jelinek et al. | |
| 2007/0210118 | A1 | 9/2007 | Gadini | |
| 2008/0000616 | A1 | 1/2008 | Nobile | |
| 2008/0077281 | A1* | 3/2008 | Gaus | 700/299 |
| 2008/0115807 | A1 | 5/2008 | Gaus | |
| 2009/0120465 | A1 | 5/2009 | Peukert et al. | |
| 2009/0151750 | A1 | 6/2009 | Ecker et al. | |
| 2009/0277482 | A1 | 11/2009 | Kim et al. | |
| 2010/0024844 | A1 | 2/2010 | Brunswick et al. | |
| 2011/0048342 | A1 | 3/2011 | Vroom | |

FOREIGN PATENT DOCUMENTS

| | | | |
|---|---|---|---|
| JP | 04187133 | A | 7/1992 |
| KR | 20080058129 | | 6/2008 |
| WO | WO 2005/055798 | | 6/2005 |
| WO | WO 2010/056794 | | 5/2010 |

* cited by examiner

WAREWASHER INCLUDING HEAT RECOVERY SYSTEM WITH HOT WATER SUPPLEMENT

CROSS-REFERENCE TO RELATED APPLICATIONS

This application claims priority to U.S. Provisional Application Ser. No. 61/043,589, filed Apr. 9, 2008, the details of which are hereby incorporated by reference as if fully set forth herein.

TECHNICAL FIELD

This application relates generally to warewasher systems which are used in commercial applications such as cafeterias and restaurants and, more particularly, to such a warewasher system including a heat recovery system with hot water supplement.

BACKGROUND

Commercial warewashers may include a heat recovery system that is installed in an outlet exhaust system of the warewasher to recover heat. The heat is usually transferred to the fresh water supply in the rinse cycle thus reducing the energy required to heat the water supply. However, upon system start up the exhaust system temperature is not sufficiently high to reach desired operating temperatures and the amount of time needed to wait for the source water to reach temperature can be objectionable.

SUMMARY

In an aspect, a warewasher for washing wares includes a housing defining an internal space with at least one spray zone for washing wares. A liquid delivery system provides a spray of liquid within the spray zone. A tank includes an inlet that is connected to a hot water source for filling the tank with hot water. The liquid delivery system receives water from the tank. An exhaust vents heated air from the housing. A final rinse system is connected to a cold water source. A heat recovery system is located between the final rinse system and the cold water source. The heat recovery system transfers heat from the exhaust air to the cold water provided from the cold water source. A valve associated with the hot water source selectively supplements the water exiting the heat recovery system with hot water from the hot water source.

In another aspect, a method of washing and rinsing wares by providing heated rinse water to a rinse station of a warewasher is provided. The method includes providing a spray of liquid to a spray zone within a housing using a liquid delivery system. A tank is filled with hot water from a hot water source and the liquid delivery system receiving water from the tank. Heated air is vented from the housing through an exhaust. A final rinse system is connected to a cold water source. Heat is transferred from the exhaust air to cold water provided from the cold water source using a heat recovery system located between the final rinse system and the cold water source. Water exiting the heat recovery system is selectively supplemented with hot water from the hot water source using a valve associated with the hot water source.

In another aspect, a warewasher for washing wares including a housing defining an internal space with at least one spray zone for washing wares. An exhaust path is provided for venting air from the housing. A liquid delivery system provides a spray of cleaning liquid within the spray zone. A final rinse system delivers a spray of rinse liquid for rinsing wares within the housing. A hot water booster feeds the final rinse system. A hot water booster filling arrangement includes a heat recovery system associated with the exhaust path. The heat recovery system is connected with a cold water input and arranged to transfer heat from exhaust air to cold water from the cold water input. An output of the heat recovery system is operatively connected to fill the hot water booster. A flow path delivers water from a hot water source to the hot water booster. A valve is located along the flow path. The valve is controlled to selectively deliver water from the hot water source to the hot water booster in dependence upon at least one monitored condition of the hot water booster filling arrangement.

The details of one or more embodiments are set forth in the accompanying drawings and the description below. Other features, objects, and advantages will be apparent from the description and drawings, and from the claims.

DETAILED DESCRIPTION

Figure 1:
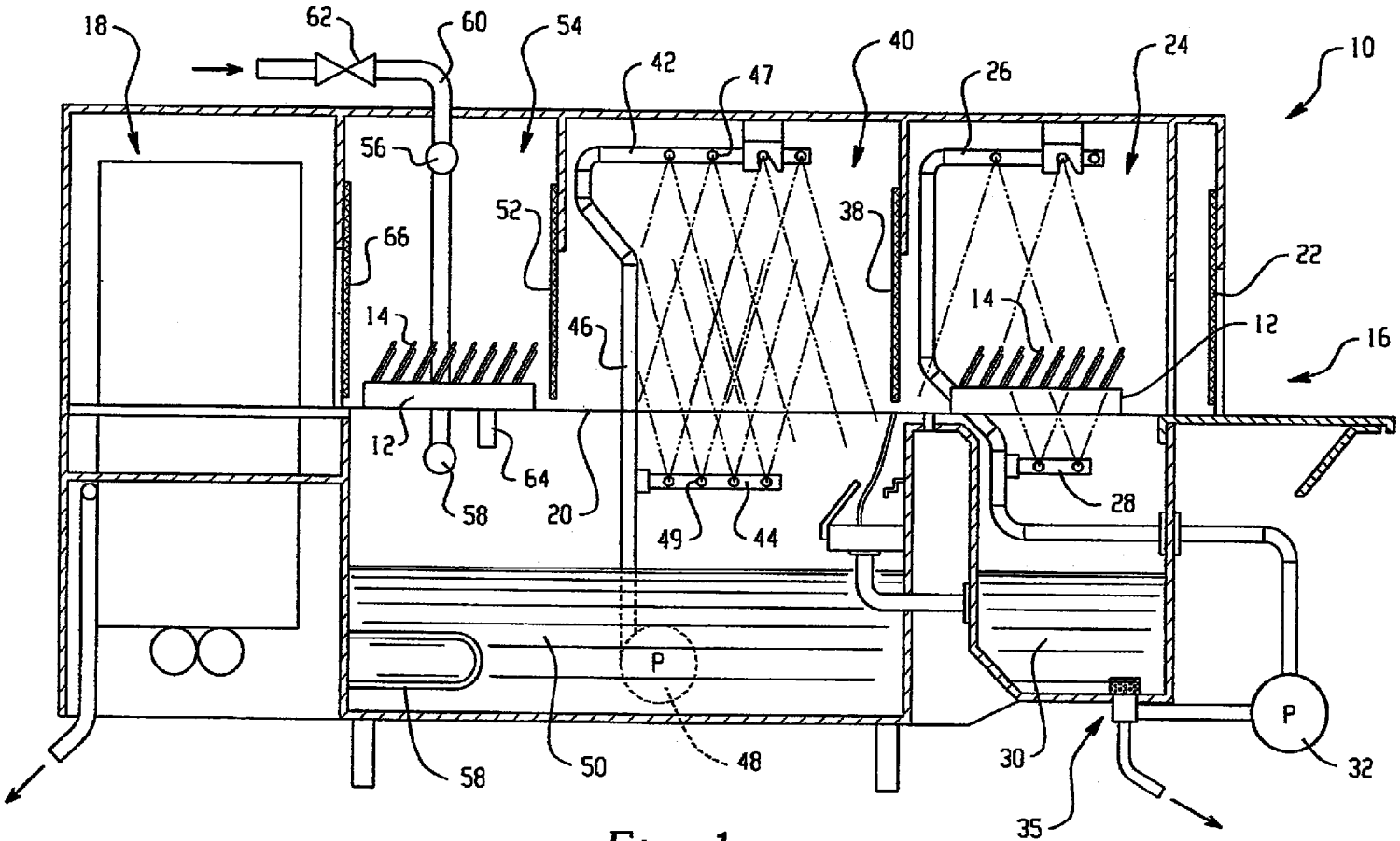
FIG. 1 is a diagrammatic, section view of an embodiment of a warewash system.

Referring to FIG. 1, an exemplary conveyor-type warewash system, generally designated 10, is shown. Warewash system 10 can receive racks 12 of soiled wares 14 from an input side 16 which are moved through tunnel-like chambers from the input side toward a dryer unit 18 at an opposite end of the warewash system by a suitable conveyor mechanism 20. Either continuously or intermittently moving conveyor mechanisms or combinations thereof may be used, depending, for example, on the style, model and size of the warewash system 10. The racks 12 of soiled wares 14 enter the warewash system 10 through a flexible curtain 22 into a pre-wash chamber or zone 24 where sprays of liquid from upper and lower pre-wash manifolds 26 and 28 above and below the racks, respectively, function to flush heavier soil from the wares. The liquid for this purpose comes from a tank 30 via a pump 32 and supply conduit 34. A drain system 35 provides a location where liquid is pumped from the tank 30 using the pump 32 and where liquid can be drained from the tank, for example, for a tank cleaning operation.

The racks proceed to a next curtain 38 into a main wash chamber or zone 40, where the wares are subject to sprays of cleansing liquid from upper and lower wash manifolds 42 and 44 with spray nozzles 47 and 49, respectively, these sprays being supplied through a supply conduit 46 by a pump 48, which draws from a main tank 50. A heater 58, such as an electrical immersion heater provided with suitable thermostatic controls (not shown), maintains the temperature of the cleansing liquid in the tank 50 at a suitable level. Not shown, but which may be included, is a device for adding a cleansing detergent to the liquid in tank 50. During normal operation, pumps 32 and 48 are continuously driven, usually by separate motors, once the warewash system 10 is started for a period of time.

The warewash system 10 may optionally include a power rinse chamber or zone (not shown) that is substantially identical to main wash chamber 40. In such an instance, racks of wares proceed from the wash chamber 40 into the power rinse chamber, within which heated rinse water is sprayed onto the wares from upper and lower manifolds.

The racks 12 of wares 14 exit the main wash chamber 40 through a curtain 52 into a final rinse chamber or zone 54. The final rinse chamber 54 is provided with upper and lower spray heads 56, 58 that are supplied with a flow of fresh hot water via pipe 60 under the control of fill valve 62. A rack detector 64 is actuated when rack 12 of wares 14 is positioned in the final rinse chamber 54 and through suitable electrical controls, the detector causes actuation of the solenoid valve 62 to open and admit the hot rinse water to the spray heads 56, 58. The water then drains from the wares into tank 50. The rinsed rack 12 of wares 14 then exit the final rinse chamber 54 through curtain 66, moving into dryer unit 18.

Figure 2:
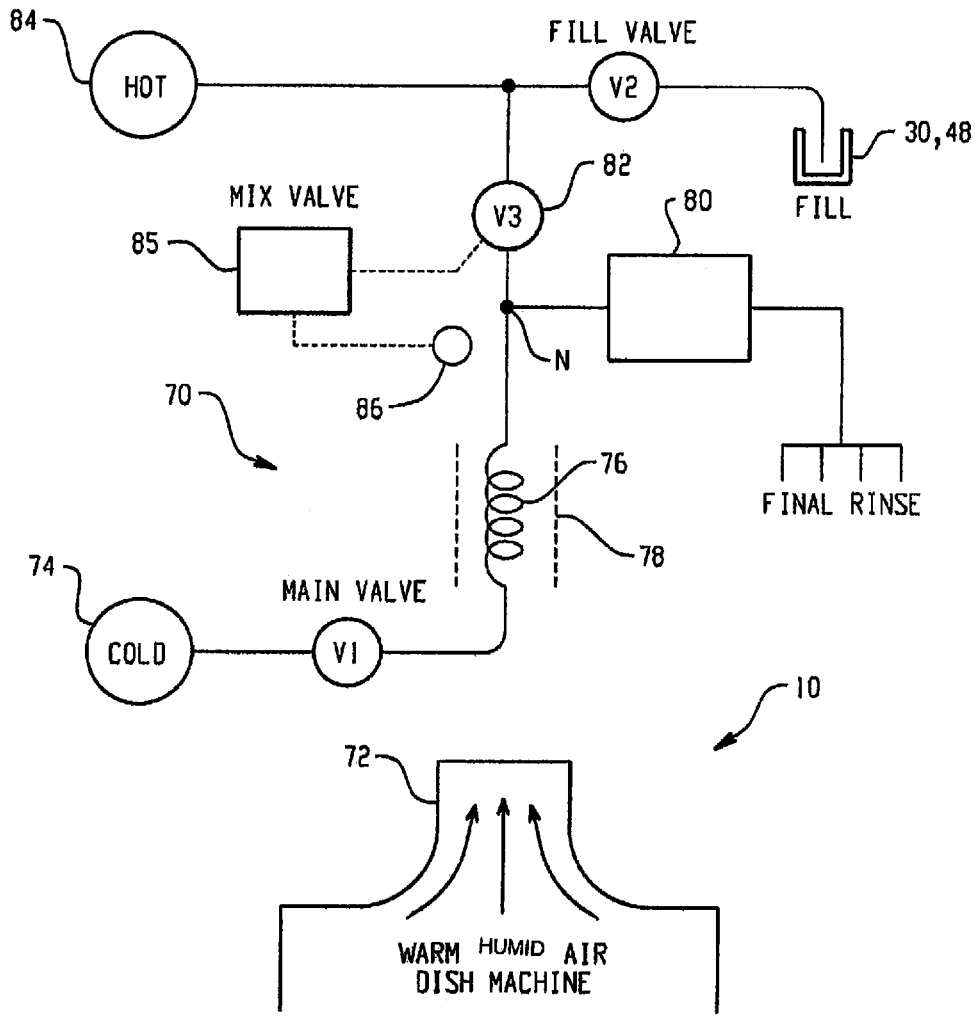
FIG. 2 is a diagrammatic illustration of an embodiment of a heat recovery system with hot water supplement for use in the warewash system of FIG. 1.

Referring now to FIG. 2, the warewash system 10 is provided with a heat recovery system 70 that utilizes warm, humid air from within the system (e.g., typically at about 105° F. to 120° F., such as 114° F.) flowing through an exhaust 72 to heat cold water (e.g., typically at about 45° F. to 60° F., such as 50° F. or 55° F.) flowing from a cold water source 74. The illustrated heat recovery system 70 includes a heat recovery coil 76 located within an exhaust conduit (represented by dashed lines 78) of the exhaust 72. The heat recovery coil 76 is in a heat exchange relationship with the warm air flowing through the exhaust conduit 78. In some embodiments, the heat exchange relationship between the heat recovery coil 76 and the heated air can provide a temperature increase in the water of about 40 to 45° F. or more. A booster heater 80 (e.g., an electric or steam booster heater) is in communication with the heat recovery coil 76 to receive water from the heat recovery coil. The booster heater 80 can provide a temperature increase to the water of about 40 to 80° F. The booster heater 80 then delivers the heated water to the final rinse station 54, e.g., at a temperature of at least about 180° F.

As can be appreciated, during start-up or reactivation of the warewash system 10, it takes time for the warm, humid air exiting the exhaust to reach temperature (e.g., about 114° F.). During this time, the water exiting the heat recovery coil 76 may not be sufficiently heated to reach the desired rinse temperature after leaving the booster heater 80 or the time period required for the booster heater to raise the water temperature to the desired rinse temperature may be deemed excessive.

A control valve 82 is provided to selectively and controllably mix hot water with water exiting the heat recovery coil 76. A temperature sensor 86 is located downstream, but near the heat recovery coil 76 to monitor the temperature of water exiting the heat recovery coil. A controller 85 receives an indication from the temperature sensor 86 and responsively opens and closes the control valve 82 based on whether the water temperature is below a predetermined temperature (e.g., about 100 to 140° F., such as about 105° F. depending on the type of booster heater 80). In one embodiment, the control valve 82 is a fully open or fully closed type valve. In this embodiment, it may be desirable to size the control valve 82 to allow in enough hot water to assure water flowing into the booster heater 80 will be at or above the predetermined temperature, even in a no heat recovery case from the heat recovery coil. If the temperature of the water exiting the heat recovery coil 76 is below the predetermined temperature, the controller 85 opens the control valve 82 thereby allowing an amount of hot water from a hot water source 84 (e.g., boiler) to supplement the cooler water flowing from the heat recovery coil in order to raise the water temperature to at least the desired temperature. If the temperature of the water exiting the heat recovery coil 76 is at or above the predetermined temperature, the controller 85 closes the control valve 82 thereby preventing hot water from the hot water source from supplementing the water flowing from the heat recovery coil. The controller 85 can continuously monitor the water temperature of water exiting the heat recovery coil 76 to open and close the control valve 82 as needed. The hot water source 84 also provides hot water (e.g., at about 120° F.) to fill the tank 30, 48 (FIG. 1) for a washing operation. In an alternative embodiment, the control valve 82 may be a modulating control valve that continuously monitors temperature of water exiting the heat recovery coil 76 using a thermostat control 86 and responsively varies an amount of hot water allowed to mix with water exiting the heat recovery coil.

Figure 3:
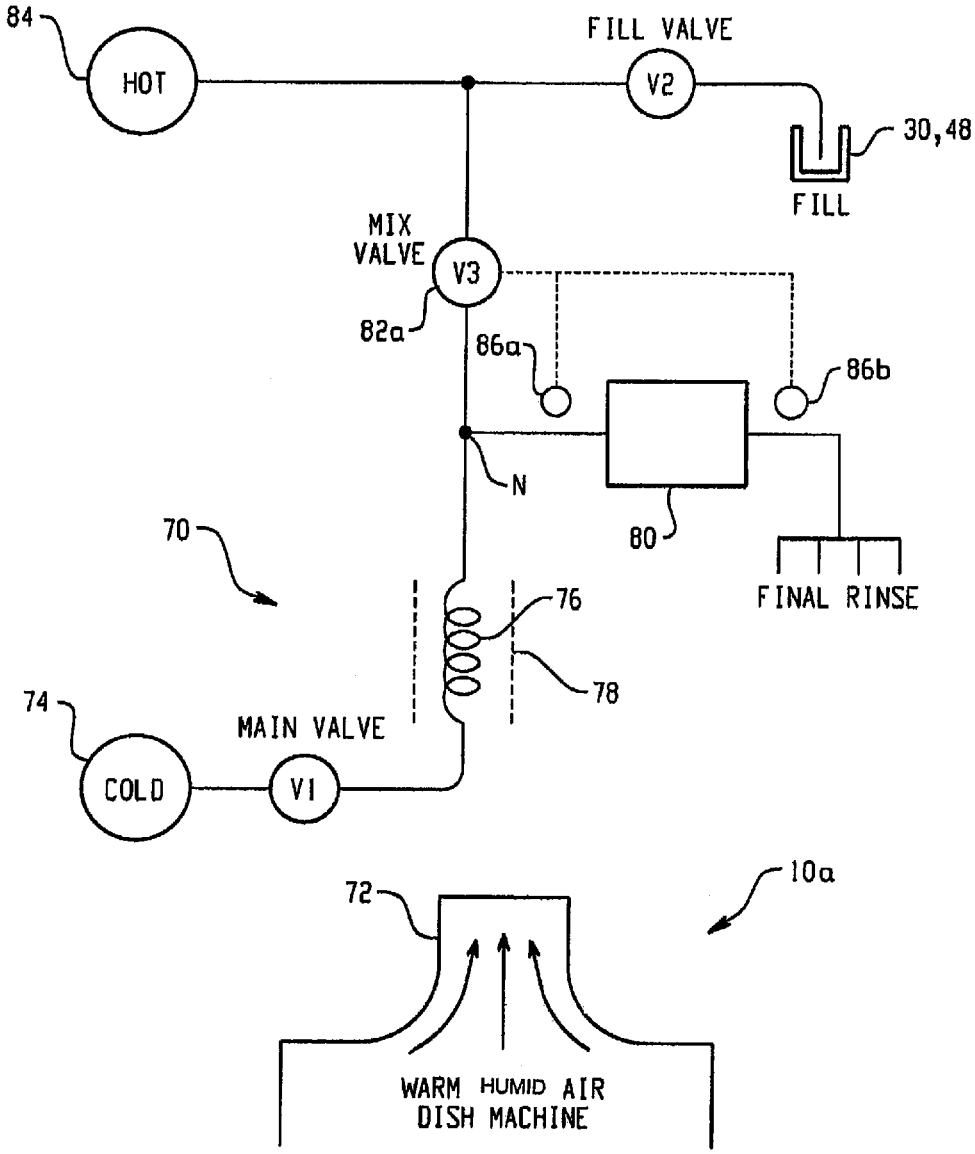
FIG. 3 is a diagrammatic illustration of another embodiment of a heat recovery system with hot water supplement for use in the warewash system of FIG. 1.

Referring now to FIG. 3, an alternative warewash system 10*a* includes a modulating control valve 82*a*. The modulating control valve includes a thermostat control 86*a* located downstream of mixing node N and upstream of the booster heater 80. The modulating control valve 82*a* varies the amount of hot water allowed to mix with the water exiting the heat recovery coil 76 based on the temperature detected by the thermostat control 86*a*. If the water entering the booster heater 80 is less than the predetermined temperature, the rate of hot water allowed to supplement the water may be increased in order to reach the desired temperature. Because the temperature of the air flow through the exhaust 72 increases as the warewash system 10 warms up, the temperature of the water entering the booster heater 80 will rise. This rise in temperature of water entering the booster heater 80 is detected by the thermostat control 86*a*, which will, in response, cause the control valve 82 to reduce the amount of hot water flowing therethrough as higher hot water flow rates will no longer be needed to reach the desired water temperature. The amount of hot water allowed to supplement the water exiting the heat recovery coil 76 may be continuously adjusted based on temperature of the water entering the booster heater 80. In an alternative embodiment, the control valve 82*a* may be a fully open and close type control valve.

FIG. 3 shows another alternative embodiment that includes a thermostat control 86*b* (represented by dashed lines) located downstream of the booster heater 80. Control valve 82*b* is opened or closed (or continuously modulated) based on whether the final rinse water is above or below the predetermined temperature (e.g., of at least about 180° F.). The embodiment of FIG. 2 could likewise be modified to place the sensor 86 downstream of the booster heater 80.

Figure 4:
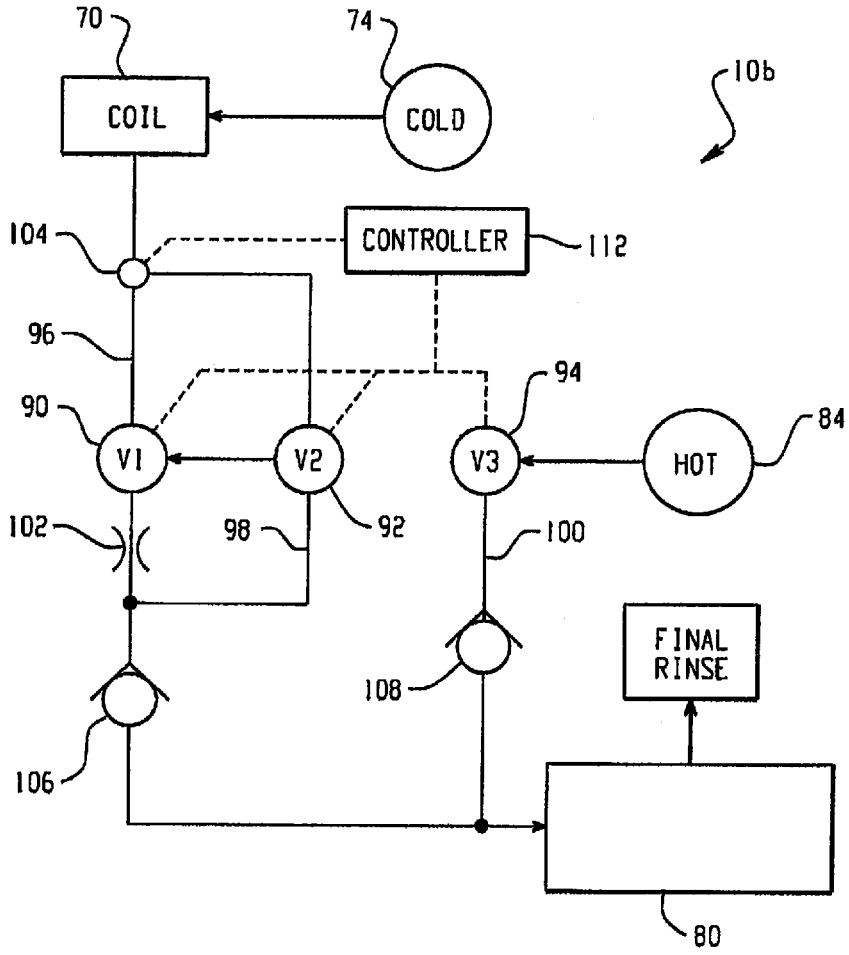
FIGS. 4 and 5 illustrate another embodiment of a heat recovery system with hot water supplement.
Figure 5:
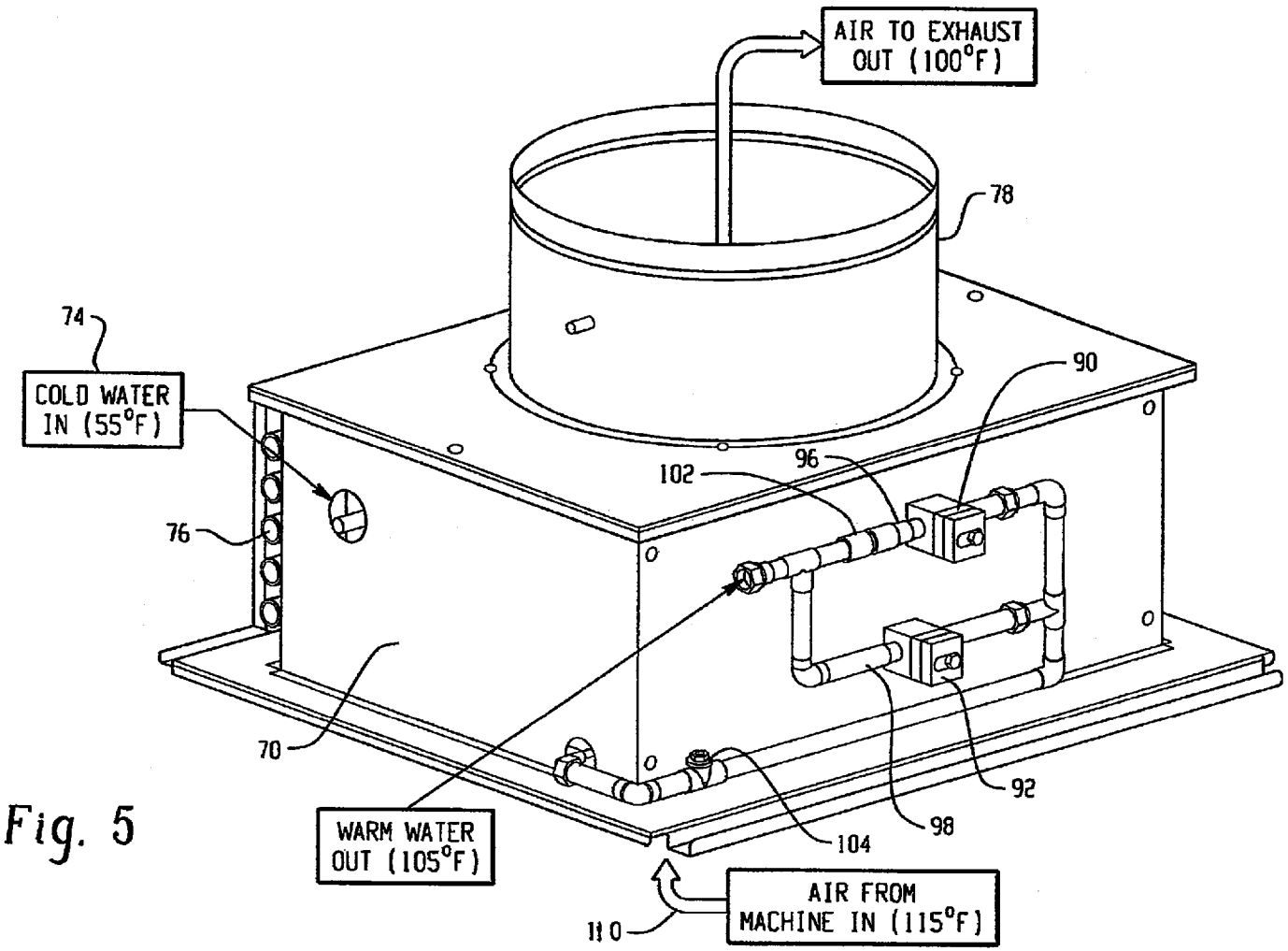

Referring now to FIGS. 4 and 5, another warewash system embodiment 10*b* is illustrated. In this embodiment, three valves 90, 92 and 94 are used to control flow of water into the booster heater 80. Valve 90 is associated with a low flow path 96 that receives water from the heat recovery coil 76 of the heat recovery system 70, valve 92 is associated with a high flow path 98 that also receives water from the heat recovery coil of the heat recovery system and valve 94 is associated with a hot water path 100 that receives hot water from the hot water source 84. Although not shown here, the hot water source 84 also fills the tank, as described above. A flow restrictor 102 is provided along the low flow path 96 for restricting flow of water therethrough when the valve 90 is open. A temperature sensor 104 is provided to monitor temperature of water flowing from the heat recovery coil 76. Check valves 106 and 108 prevent back flow of water into the paths 96, 98 and 100.

When temperature of the water flowing from the heat recovery coil 76 is at or below a predetermined temperature (e.g., between 100° F. and 140° F., such as about 105° F.), the valve 90 associated with the low flow path 96 and the valve 94 associated with the hot water path 100 are opened (or allowed to remain open) and the valve 92 associated with the high flow path 98 is closed (or remains closed) such that only a small portion of the water entering the booster heater 80 comes from the heat recovery coil 76 and a majority of the water entering the booster heater 80 comes from the hot water source 84. When the air in to the heat recovery system 70 (see arrow 110) heats the cold water flowing into the heat recovery coil 76 to or above the predetermined temperature, the valves 90 and 94 are closed and the valve 92 is opened such that all the water entering the booster heater 80 is provided from the heat recovery coil 76.

As described above, the valves 90, 92 and 94 are fully open or fully closed type valves. However, the valves 90, 92 and 94 may be modulated valves. The valves 90, 92 and 94 may be controlled by a controller 112, for example, that receives a signal from the temperature sensor indicative of temperature. Or, for example, the valves 90, 92 and 94 may be switched open or closed directly by a signal from the temperature sensor.

The above-described heat recovery systems with hot water supplement can be advantageous in a number of ways including during an initial start-up operation to reduce the amount of time needed for the final rinse water to reach the desired temperature of 180° F. For example, hot water may be used to supplement the water exiting the heat recovery coil 76 when the warewash system 10 is activated, but has been idle for some time. In certain embodiments, the thermostat control 86 may monitor water temperature only during an initial start up period, or the thermostat control may be used to continuously monitor water temperature throughout operation of the warewash system 10. Hot water may be mixed with the water exiting the heat recovery coil 76 in situations where the heat recovery coil's efficiency has decreased, for example, due to clogging. In some embodiments, the hot water supplement may be used continuously to bring the water exiting the heat recovery coil 76 up to temperature. For example, in some buildings, the cold water source 74 may provide cold water at a temperature less than 50 degrees such that the temperature increase provided by the heated air in the exhaust 72 cannot bring the temperature of the water exiting the heat recovery coil to the desired temperature. In these instances, the water exiting the heat recovery coil 76 may be continuously supplemented with the hot water from the hot water source 84. The above-described heat recovery system 70 may be used with a number of commercial warewashers such as the FT900 Flight Type warewasher or the C-Line warewasher, both commercially available from Hobart Corp., Troy Ohio. Significant energy savings can be realized without sacrificing high temperature rinse performance.

It is to be clearly understood that the above description is intended by way of illustration and example only and is not intended to be taken by way of limitation, and that changes and modifications are possible. For example, other configurations of heat recovery systems could be provided for transferring heat from the machine exhaust air to the incoming cold water (e.g., a heat pump arrangement). Further, while the downstream side of the hot water supplement control valve is shown and described as joining with the flow path of water exiting the heat recovery system, embodiments are contemplated in which the hot water flow path leads directly into the booster without pre-mixing with the water exiting the heat recovery system. Accordingly, other embodiments are contemplated and modifications and changes could be made without departing from the scope of this application.

What is claimed is:

1. A method of washing and rinsing wares by providing heated rinse water to a rinse station of a warewasher, the method comprising:

providing a spray of liquid to a spray zone within a housing a liquid delivery system;

venting heated air from the housing through an exhaust;

providing a final rinse system operatively connected to a cold water source;

pre-heating water for rinsing by transferring heat from the exhaust air to cold water provided from the cold water source using a heat recovery system located between the final rinse system and the cold water source;

identifying a low temperature condition of the heat recovery system; and selectively delivering hot water from a hot water source to the final rinse system using a valve associated with a hot water source upon identification of the low temperature condition of the heat recovery system.

2. The method of claim 1 further comprising monitoring water temperature at a location downstream of the heat recovery system using a temperature sensor, the temperature sensor providing a signal of water temperature.

3. The method of claim 2, wherein the step of selectively delivering hot water includes opening the valve if the temperature of water exiting the heat recovery system is below a predetermined temperature and closing the valve if the water exiting the heat recovery system is above the predetermined temperature.

4. The method of claim 2, wherein the valve is a first valve, the step of selectively delivering hot water includes opening the first valve if the temperature of water exiting the heat recovery system is at or below a predetermined temperature;

opening a second valve associated with a low flow path that receives water from the heat recovery system; and closing a third valve associated with a high flow path that receives water from the heat recovery system.

5. The method of claim 4, wherein the predetermined temperature is between about 100 degrees F. and about 140 degrees F.

6. The method of claim 1, wherein the valve is a modulating control valve including a thermostat control.

7. The method of claim 1 wherein the final rinse system includes a hot water booster, the method further comprising, after selectively delivering hot water from the hot water source to the final rinse system, heating water exiting the heat recovery system using a booster heater.

8. The method of claim 1, wherein the heat recovery system comprises a heat recovery coil through which water travels located within the exhaust.

9. A method of delivering water to a heating tank of a warewasher, the method comprising:

providing a flow path from a cold water source to the heating tank;

pre-heating water by transferring heat from exhaust air to cold water traveling along the flow path using a heat recovery system located along the flow path; and detecting a low temperature condition of the heat recovery system and responsively delivering hot water from a hot water source to the heating tank.

10. The method of claim 9 wherein a first valve controls flow of cold water from the cold water source, a second valve controls flow of water from the hot water source, if the second valve is closed and the first valve is open and the low temperature condition is detected the second valve is automatically opened and the first valve is automatically closed.

11. The method of claim 10 wherein the hot water is delivered to the heating tank along a water path that is external of the heat recovery system.

12. A method of cleaning wares within a warewasher, the method comprising:

spraying cleaning liquid onto wares within the warewasher;

exhausting air from within the ware washer along a path that includes a heat recovery coil;

providing a water flow path from a cold water source through the heat recovery coil to a water heating tank;

pre-heating water by transferring heat from exhaust air to cold water traveling along the flow path using the heat recovery coil; and detecting a heat recovery low temperature condition and responsively delivering hot water from a hot water source to the water heating tank.

13. The method of claim 12 wherein a first valve controls flow of cold water from the cold water source, a second valve controls flow of water from the hot water source, if the second valve is closed and the first valve is open during the transferring step and the heat recovery low temperature condition is detected, the second valve is automatically opened and the first valve is automatically closed.

14. The method of claim 13 wherein the heat recovery low temperature condition is detected via a temperature sensor that detects temperature of water output by the heat recovery coil.

15. The method of claim 13 wherein the heat recovery low temperature condition is detected via a temperature sensor that detects temperature of exhaust air.

16. The method of claim 13 wherein the heat recovery low temperature condition is detected via a temperature sensor that detects temperature of water output by the water heating tank.

* * * * *

UNITED STATES PATENT AND TRADEMARK OFFICE

CERTIFICATE OF CORRECTION

PATENT NO. : 8,663,395 B2
APPLICATION NO. : 13/416720
DATED : March 4, 2014
INVENTOR(S) : Warner et al.

It is certified that error appears in the above-identified patent and that said Letters Patent is hereby corrected as shown below:

In the Claims

Claim 1, Column 6, Line 6 before “a” insert --using--

Signed and Sealed this
Tenth Day of June, 2014

Michelle K. Lee

Michelle K. Lee
*Deputy Director of the United States Patent and Trademark Office*